US005961393A

United States Patent [19]

Heller et al.

[11] Patent Number: 5,961,393

[45] Date of Patent: Oct. 5, 1999

[54] GOLF SWING TRAINING DEVICE

[76] Inventors: Bruce Heller, 2485 W. Wigwam #18, Las Vegas, Nev. 89123; James Craig, 6563 Casa Linda Dr., Las Vegas, Nev. 89103

[21] Appl. No.: 09/124,725

[22] Filed: Jul. 30, 1998

[51] Int. Cl.[6] ..... A63B 69/36

[52] U.S. Cl. ..... 473/264; 473/265

[58] Field of Search ..... 473/265, 261, 473/263, 264

[56] References Cited

U.S. PATENT DOCUMENTS 3,572,720 3/1971 Berg ..... 473/265
3,741,550 6/1973 Landures ..... 473/265
4,437,669 3/1984 Pelz ..... 473/265
4,930,786 6/1990 Bencriscutto ..... 473/265

*Primary Examiner*—George J. Marlo

[57] ABSTRACT

A golf swing training device for improving the swing of a golfer. The device includes a base block with a plurality of elongate guide rods extending therefrom whose tips demarcate the proper path of a head of a golf club when swinging the golf club at the golf ball. A spaced apart pair of generally rectangular stabilizing legs are outwardly extended from the distal face of the base block. The stabilizing legs each are positioned adjacent the bottom side of the base block such that the lower portions of the stabilizing legs and the bottom side of the base block are coplanar with one another.

7 Claims, 2 Drawing Sheets

FIG 1
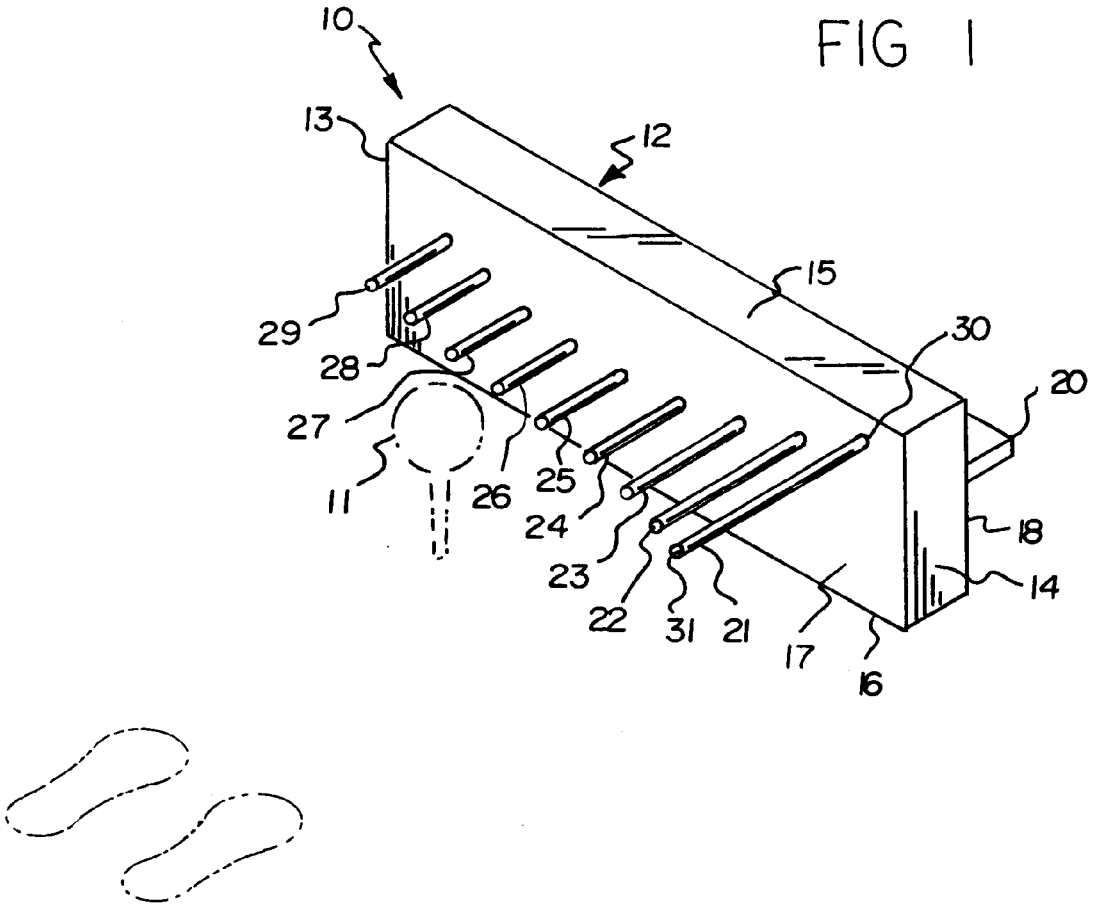
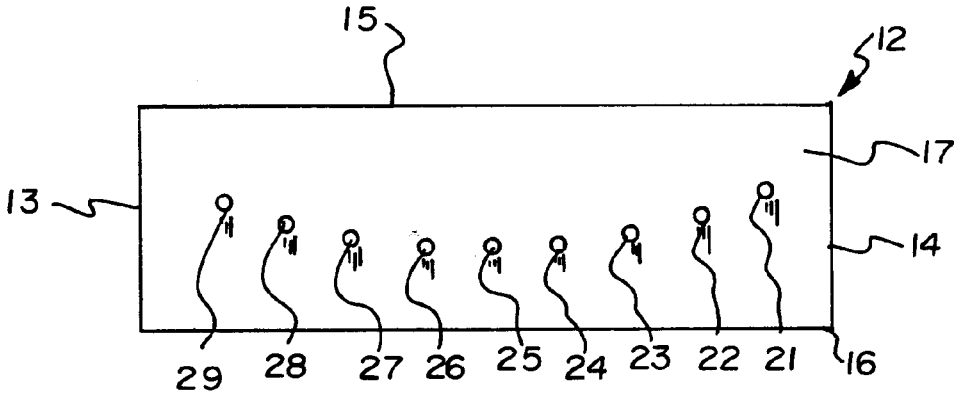
FIG 2

FIG 3
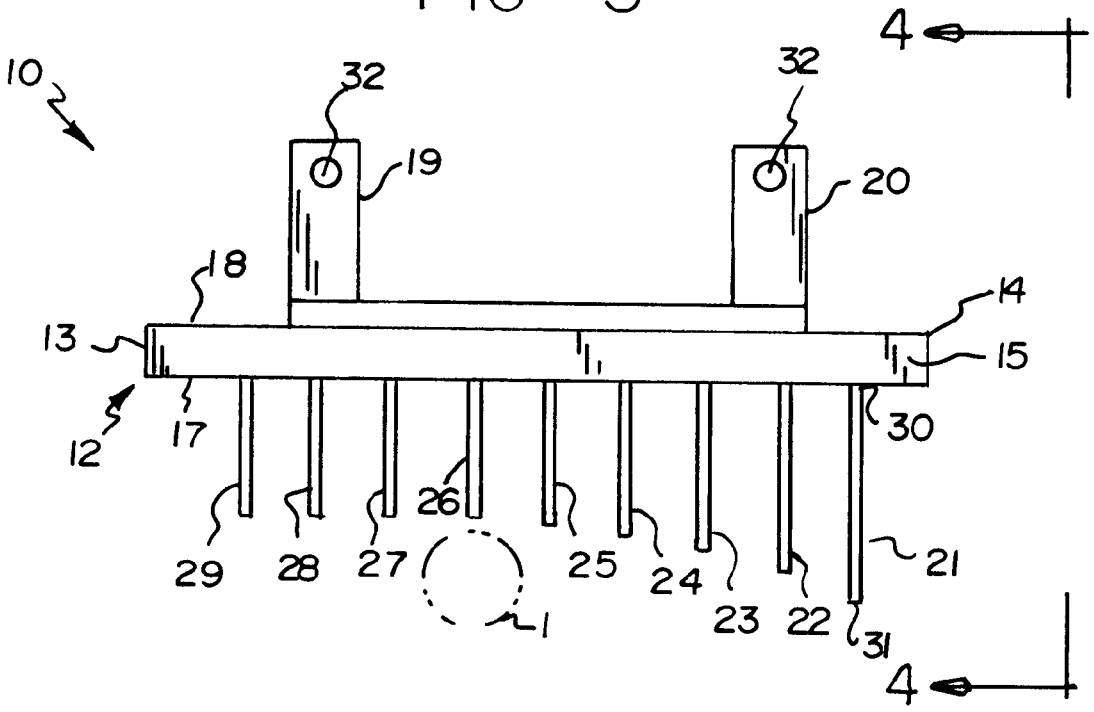
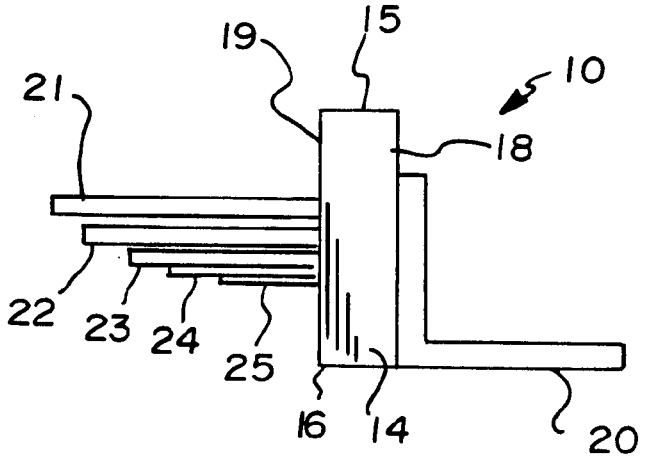
FIG 4

GOLF SWING TRAINING DEVICE

BACKGROUND OF THE INVENTION

1. Field of the Invention

The present invention relates to golf training devices and more particularly pertains to a new golf swing training device for improving the swing of a golfer.

2. Description of the Prior Art

The use of golf training devices is known in the prior art. More specifically, golf training devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf training devices include U.S. Pat. No. 2,152,381; U.S. Pat. No. 4,913,440; U.S. Pat. No. Des. 358,440; U.S. Pat. No. 4,732,390; U.S. Pat. No. 4,465,281; and U.S. Pat. No. 3,246,898.

While these devices fulfill their respective, particular objectives and requirements, the aforementioned patents do not disclose a new golf swing training device. The inventive device includes a base block with a plurality of elongate guide rods extending therefrom for demarcating the proper path of a head of a golf club when swinging the golf club at the golf ball.

In these respects, the golf swing training device according to the present invention substantially departs from the conventional concepts and designs of the prior art, and in so doing provides an apparatus primarily developed for the purpose of improving the swing of a golfer.

SUMMARY OF THE INVENTION

In view of the foregoing disadvantages inherent in the known types of golf training devices now present in the prior art, the present invention provides a new golf swing training device construction wherein the same can be utilized for improving the swing of a golfer.

The general purpose of the present invention, which will be described subsequently in greater detail, is to provide a new golf swing training device apparatus and method which has many of the advantages of the golf training devices mentioned heretofore and many novel features that result in a new golf swing training device which is not anticipated, rendered obvious, suggested, or even implied by any of the prior art golf training devices, either alone or in any combination thereof.

To attain this, the present invention generally comprises a base block with a plurality of elongate guide rods extending therefrom for demarcating the proper path of a head of a golf club when swinging the golf club at the golf ball.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing training device apparatus and method which has many of the advantages of the golf training devices mentioned heretofore and many novel features that result in a new golf swing training device which is not anticipated, rendered obvious, suggested, or even implied by any of the prior art golf training devices, either alone or in any combination thereof.

It is another object of the present invention to provide a new golf swing training device which may be easily and efficiently manufactured and marketed.

It is a further object of the present invention to provide a new golf swing training device which is of a durable and reliable construction.

An even further object of the present invention is to provide a new golf swing training device which is susceptible of a low cost of manufacture with regard to both materials and labor, and which accordingly is then susceptible of low prices of sale to the consuming public, thereby making such golf swing training device economically available to the buying public.

Still yet another object of the present invention is to provide a new golf swing training device which provides in the apparatuses and methods of the prior art some of the advantages thereof, while simultaneously overcoming some of the disadvantages normally associated therewith.

Still another object of the present invention is to provide a new golf swing training device for improving the swing of a golfer.

Yet another object of the present invention is to provide a new golf swing training device which includes a base block with a plurality of elongate guide rods extending therefrom for demarcating the proper path of a head of a golf club when swinging the golf club at the golf ball.

Still yet another object of the present invention is to provide a new golf swing training device that demarcates the proper swing path for the head of a golf club for both the take-away swing and the downswing through the golf ball impact area to strike the golf ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new golf swing training device according to the present invention with the location of where a user stands illustrated by a pair of footprints in broken lines.

FIG. 2 is a schematic side view of the proximal face of the present invention.

FIG. 3 is a schematic top side view of the present invention.

FIG. 4 is a schematic end view of the back end of the present invention.

DESCRIPTION OF THE PREFERRED EMBODIMENT

With reference now to the drawings, and in particular to FIGS. 1 through 4 thereof, a new golf swing training device embodying the principles and concepts of the present invention and generally designated by the reference numeral 10 will be described.

The golf swing training device 10 is designed for helping properly align the golf swing of a user when striking a ball 1. As best illustrated in FIGS. 1 through 4, the golf swing training device 10 generally comprises a base block 12 with a plurality of elongate guide rods 21,22,23,24,25,26,27,28,29 extending therefrom for demarcating the proper path of a head of a golf club when swinging the golf club at the golf ball 11.

In closer detail, the base block 12 is generally rectangular in configuration and has generally planar front and back ends 13,14, generally planar top and bottom sides 15,16, and generally planar proximal and distal faces 17,18. The longitudinal axis of the base block extends between the front and back ends 13,14 of the base block 12. Preferably, the front and back ends 13,14 of the base block 12 are in generally parallel planes with one another, while the top and bottom sides 15,16 of the base block 12 lie in generally parallel planes with one another and generally perpendicular to the planes of the front and back ends 13,14. Similarly, the proximal and distal faces 17,18 of the base block 12 preferably lie in generally parallel planes with one another and generally perpendicular to the planes of the front and back ends 13,14 of the base block 12 and the planes of the top and bottom ends of the base block 12. In use, the bottom side 16 of the base block 12 is designed for resting on a ground surface proximate a golf ball 11 on a golf tee on the ground surface such that the proximal face 17 of the base block 12 faces and is spaced apart from the golf ball 11. The front end 13 of the base block 12 is positioned so that it faces in a direction towards the direction of travel of the golf ball 11 towards the target of the golf ball 11 such that the longitudinal axis of the base block 12 extends in a direction generally parallel to the desired direction of travel of the golf ball 11. Optionally, a pair of spaced apart stabilizing legs 19,20 are outwardly extended from the distal face 18 of the base block 12. The stabilizing legs 19,20 are positioned adjacent the bottom side 16 of the base block 12 such that the stabilizing legs 19,20 and bottom side 16 of the base block 12 are generally coplanar. The stabilizing legs 19,20 are designed for stabilizing the base block 12 when the base block 12 is rested on the ground surface. Preferably, each of the support legs has a hole 32 therethrough adapted for extending a fastener therethrough such as a stake to help secure the stabilizing legs 19,20 and base block 12 to the ground surface.

A plurality of elongate guide rods 21,22,23,24,25,26,27,28,29 are provided for demarcating the proper path of a head of a golf club when swinging the golf club at the golf ball 11. The guide rods are outwardly extended from the proximal face 17 of the base block 12. Ideally, the plurality of guide rods comprises nine guide rods. Each of the guide rods 21,22,23,24,25,26,27,28,29 has a root 30, a tip 31, and a longitudinal axis extending between the root 30 and tip 31. The root 30 of each of the guide rods 21,22,23,24,25,26,27,28,29 is coupled and located adjacent the proximal face 17 of the base block 12 such that the tips 31 of the guide rods extend outwardly away from the proximal face 17 of the base block 12. Preferably, each of the guide rods is a generally flexible tube and generally cylindrical such that each guide rod has a generally circular cross-section taken generally perpendicular to the longitudinal axis of the guide rod.

The guide rods are arranged in a row extending between the front and back ends 13,14 of the base block 12. The guide rods are spaced apart from each other in the row preferably in generally equal intervals from one another in the row. The row of guide rods is generally arcuate in shape and has a concavity extending towards the bottom side 16 of the base block 12. The concavity of the row of the guide rows is adapted to conform to the proper path of a swing by the golf club to strike the golf ball 11 in such a manner to send the golf ball 11 in the desired direction of travel. The row of guide rods has opposite front and rear terminal guide rods 21,29. The front terminal guide rod 29 is located towards the front end 13 of the base block 12 and the rear terminal guide rod 21 is located towards the back end 14 of the base block 12. The terminal guide rods 21,29 are positioned closer towards the top side 15 of the base block 12 than the other guide rods 22,23,24,25,26,26,28 in the row.

The row of guide rods is divided into a group of approach guide rods 21,22,23,24,25,26 and a group of follow-through guide rods 27,28,29. The group of approach guide rods 21,22,23,24,25,26 is located towards the rear terminal guide rod 21 towards the back end 14 of the base block 12. The rear terminal guide rod 21 is included in the group of approach guide rods 21,22,23,24,25,26. The group of follow-through guide rods 27,28,29 is located towards the front terminal guide rod 29 towards the front end 13 of the base block 12. The front terminal guide rod 29 is included in the group of follow-through guide rods 27,28,29. Ideally, the group of follow-through guide rods 27,28,29 comprises three guide rods and the group of approach guide rods 21,22,23,24,25,26 comprises six guide rods.

Each of the guide rods has a length defined between the root 30 and the tip of the guide rod. The lengths of the guide rods are adapted to conform to the proper path of a swing by the golf club to strike the golf ball 11 in such a manner to send the golf ball 11 in the desired direction of travel as best illustrated in FIG. 3. The lengths of each of the approach guide rods 21,22,23,24,25,26 is greater then each of the lengths of the follow-through guide rods 27,28,29. The lengths of the approach guide rods 21,22,23,24,25,26 gradually shorten in a direction in the row of guide rods from the back end 14 of the base block 12 towards the front end 13 of the base block 12 such that the length of the rear terminal rod is the longest of the lengths of the approach guide rods 21,22,23,24,25,26 and the length of the approach guide rod 26 closest to the follow-through guide rods 27,28,29 is the shortest of the approach guide rods. The tips 31 of the approach guide rods 21,22,23,24,25,26 define a generally arcuate approach path for the head of the golf club. The lengths of the follow-through guide rods 27,28,29 are generally equal to one another such that the tips 31 of the follow-through guide rods 27,28,29 define a path extending in a vector parallel to the direction of desired travel of the golf ball 11. Optionally, a guide line extending between the front and back ends 13,14 of the base block 12 may also be included on the top side 15 of the base block 12 to help indicate the direction of travel of the golf ball 11.

In an ideal illustrative embodiment, the base block 12 has a length defined between the front and back ends 13,14 of about 7 inches, a thickness defined between the proximal and distal faces 17,18 of the base block 12 of between about ½ inch and 1 inch and a height defined between the top and bottom sides 15,16 of the base block 12 of about 3¾ inches.

In use, a golfer would place the block on the ground surface so that the guide line extends in a direction towards the intended target and the golfer facing towards the proximal face 17 of the base block 12. The golf ball 11 is then placed at a point between the shortest approach guide rod and the closest follow-through guide rod. The head of the golf club behind the golf ball 11 and adjacent the tips 31 of the guide rods. With the ball in this starting position, the golfer then takes his normal stance and tries to swing the club without hitting the guide tubes. Following the guide tubes on the back swing would start the club in the correct plane while avoid touching the guide tubes on the downswing prevents the golfer from "coming over the top" and hitting the ball with an outside-in sing that causes the ball to slice.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A golf swing training device, comprising:

a base block and having front and back ends, top and bottom sides, and proximal and distal faces;

a plurality of elongate guide rods for demarcating the proper path of a head of a golf club when swinging the golf club at the golf ball, said guide rods being outwardly extended from said proximal face of said base block; and said guide rods being adapted to demarcate a proper path of a swing by a golf club to strike a golf ball in such a manner to send the golf ball in the desired direction of travel;

a spaced apart pair of generally rectangular stabilizing legs outwardly extending from said distal face of said base block;

said stabilizing legs each being positioned adjacent said bottom side of said base block such that said lower portions of said stabilizing legs and said bottom side of said base block are coplanar with one another.

2. The golf swing training device of claim 1, wherein each of said guide rods having a root, a tip, and a longitudinal axis extending between said root and tip, said root of each of said guide rods being located adjacent said proximal face of said base block such that said tips of said guide rods extend outwardly away from said proximal face of said base block, said tips of said rods defining an arcuate swing path for a golf head of a user's golf club, said arcuate swing path defining concave arcs in both a horizontal plane and a vertical plane said arc in said horizontal plane facing outwards from said proximal face of said base block, and said arc in said vertical plane facing upwards from the ground surface.

3. The golf swing training device of claim 2, wherein each of said guide rods is tubular and generally cylindrical such that each guide rod has a generally circular cross-section taken generally perpendicular to the longitudinal axis of the guide rod.

4. The golf swing training device of claim 1, wherein said guide rods are arranged in a row extending between said front and back ends of said base block, said guide rods being spaced apart from each other in said row.

5. The golf swing training device of claim 4, wherein said guide rods are spaced apart in generally equal intervals in said row.

6. The golf swing training device of claim 4, wherein said row of guide rods is generally arcuate in shape and has a concavity extending towards said bottom side of said base block, said concavity of said row of said guide rows being adapted to conform to the proper path of a swing by the golf club to strike the golf ball in such a manner to send the golf ball in the desired direction of travel.

7. A golf swing training device, comprising:

a base block being generally rectangular and having generally planar front and back ends, generally planar top and bottom sides, and generally planar proximal and distal faces;

said base block having a longitudinal axis extending between said front and back ends of said base block;

said front and back ends of said base block lying in generally parallel planes with one another, said top and bottom sides of said base block lying in generally parallel planes with one another and generally perpendicular to said planes of said front and back ends, said proximal and distal faces of said base block lying in generally parallel planes with one another and generally perpendicular to said planes of said front and back ends of said base block and said planes of said top and bottom ends of said base block;

said bottom side of said base block being for resting on a ground surface proximate a golf ball on the ground surface such that said proximal face of said base block faces and is spaced apart from the golf ball, said front end of said base block facing in a direction towards the direction of travel of the golf ball such that said longitudinal axis of said base block extends in a direction generally parallel to the desired direction of travel of the golf ball;

a plurality of elongate guide rods for demarcating the proper path of a head of a golf club when swinging the golf club at the golf ball, said guide rods being outwardly extended from said proximal face of said base block, wherein said plurality of guide rods comprises nine guide rods;

each of said guide rods having a root, a tip, and a longitudinal axis extending between said root and tip, said root of each of said guide rods being located adjacent said proximal face of said base block such that said tips of said guide rods extend outwardly away from said proximal face of said base block;

each of said guide rods being tubular and generally cylindrical such that each guide rod has a generally circular cross-section taken generally perpendicular to the longitudinal axis of the guide rod;

said guide rods being arranged in a row extending between said front and back ends of said base block, said guide rods being spaced apart from each other in said row, wherein said guide rods are spaced apart in generally equal intervals in said row;

said row of guide rods being generally arcuate in shape and having a concavity extending towards said bottom side of said base block, said concavity of said row of said guide rows being adapted to conform to the proper path of a swing by the golf club to strike the golf ball in such a manner to send the golf ball in the desired direction of travel;

said row of guide rods having opposite front and rear terminal guide rods, said front terminal guide rod being located towards said front end of said base block, said rear terminal guide rod being located towards said back end of said base block, said terminal guide rods being positioned closer towards said top side of said base block than the other guide rods in said row;

said row of guide rods being divided into a group of approach guide rods and a group of follow-through guide rods;

said group of approach guide rods being located towards said rear terminal guide rod towards said back end of said base block, said rear terminal guide rod being included in said group of approach guide rods;

said group of follow-through guide rods being located towards said front terminal guide rod towards said front end of said base block, said front terminal guide rod being included in said group of follow-through guide rods;

wherein said group of follow-through guide rods comprises three guide rods, wherein said group of approach guide rods comprises six guide rods;

each of said guide rods having a length defined between said root and said tip of said guide rod;

said lengths of said guide rods being adapted to conform to the proper path of a swing by the golf club to strike the golf ball in such a manner to send the golf ball in the desired direction of travel;

said lengths of each of said approach guide rods being greater then each of said lengths of said follow-through guide rods;

said lengths of said approach guide rods gradually shortening in a direction in said row of guide rods from said back end of said base block towards said front end of said base block such that said length of said rear terminal rod is the longest of the lengths of the approach guide rods and the length of the approach guide rod closest to the follow-through guide rods is the shortest of the approach guide rods;

said lengths of said follow-through guide rods being generally equal to one another;

said tips of said rods defining an arcuate swing path for a golf head of a user's golf club, said arcuate swing path defining concave arcs in both a horizontal plane and a vertical plane;

said arc in said horizontal plane facing outwards from said proximal face of said base block;

said arc in said vertical plane facing upwards from the ground surface;

a spaced apart pair of generally rectangular stabilizing legs outwardly extending from said distal face of said base block;

said stabilizing legs each being positioned adjacent said bottom side of said base block such that said lower portions of said stabilizing legs and said bottom side of said base block are coplanar with one another; and each of said support legs having a hole therethrough adapted for extending a fastener therethrough for securing said stabilizing legs to a ground surface.

* * * * *